US006193442B1

(12) United States Patent
May

(10) Patent No.: US 6,193,442 B1
(45) Date of Patent: Feb. 27, 2001

(54) METHOD AND DEVICE FOR RAISING AND SUPPORTING A BUILDING FOUNDATION

(76) Inventor: Donald R. May, 25662 S. Brentwood, Sun Lakes, AZ (US) 85248

( * ) Notice: Subject to any disclaimer, the term of this patent is extended or adjusted under 35 U.S.C. 154(b) by 0 days.

(21) Appl. No.: 09/270,166

(22) Filed: Mar. 16, 1999

(51) Int. Cl.[7] ..... E02D 5/80; E02D 7/10; E02D 27/50; E02D 35/00

(52) U.S. Cl. ..... 405/232; 405/244; 405/249; 405/251; 52/169.9; 52/125.1; 52/126.7

(58) Field of Search ..... 405/229, 231, 405/232, 244, 249, 251; 52/169.9, 125.1, 126.7

(56) References Cited

U.S. PATENT DOCUMENTS

| | | | | |
|---|---|---|---|---|
| 4,070,867 | * | 1/1978 | Cassidy | 405/231 |
| 4,634,319 | | 1/1987 | May | 405/230 |
| 4,667,746 | | 5/1987 | Moraly | 174/89 |
| 4,673,315 | | 6/1987 | Shaw et al. | 405/230 |
| 4,678,373 | | 7/1987 | Langenbach, Jr. | 405/230 |
| 4,733,994 | | 3/1988 | Simanjuntak | 405/244 |
| 4,800,700 | | 1/1989 | May | 52/741.15 |
| 4,854,782 | | 8/1989 | May | 405/230 |
| 4,925,345 | * | 5/1990 | McCown, Jr. et al. | 405/232 |
| 5,011,336 | | 4/1991 | Hamilton et al. | 405/230 |
| 5,013,190 | | 5/1991 | Green | 405/230 |
| 5,123,209 | | 6/1992 | Nally | 52/165 |
| 5,154,539 | * | 10/1992 | McCown, Sr. et al. | 405/230 |
| 5,205,673 | * | 4/1993 | Bolin et al. | 405/230 |
| 5,234,287 | * | 8/1993 | Rippe, Jr. | 405/230 |
| 5,246,311 | | 9/1993 | West et al. | 405/230 |
| 5,253,958 | | 10/1993 | Bellemare | 405/232 |
| 5,288,175 | | 2/1994 | Knight | 405/230 |
| 5,310,287 | | 5/1994 | Arentsen | 405/246 |
| 5,336,021 | | 8/1994 | Freeman, III | 405/230 |
| 5,492,437 | | 2/1996 | Ortiz | 405/230 |
| 5,980,162 | * | 11/1999 | McCown | 405/244 |

* cited by examiner

*Primary Examiner*—Eileen D. Lillis
*Assistant Examiner*—Tara L. Mayo
(74) *Attorney, Agent, or Firm*—The Halvorson Law Firm

(57) ABSTRACT

A lifting assembly for raising and supporting the foundation of a structure made of a bracket that secures to the base of the building foundation, a pier driven into the ground to a layer bedrock, a pier support secured to the bracket through which the pier extends, two shafts which secure a pier plate and a hydraulic plate to the pier support, the pier plate rests on the top end of the pier, a hydraulic jack is placed on top of the pier plate, the hydraulic plate is rigidly secured to the shafts whereby when the hydraulic jack is activated, the hydraulic jack held in a fixed position by the hydraulic plate forces the pier plate down driving the pier into the ground.

14 Claims, 5 Drawing Sheets

METHOD AND DEVICE FOR RAISING AND SUPPORTING A BUILDING FOUNDATION

FIELD OF THE INVENTION

The present invention relates to the field of devices and methods for lifting and supporting a structure such as a building and more particularly to hydraulic lifting devices and methods for lifting the foundation of a structure by driving one or more piers into the ground and securing each pier to the foundation once the foundation is raised to the desired level.

BACKGROUND

Many structures, such as residential homes and low rise buildings, are constructed on foundations that are not in direct contact with a stable load bearing underground stratum, such as, for example, bedrock. These foundations are typically concrete slabs. Alternative structures for these foundations are comprised of a footing upon which a foundation wall rests. The footing is generally wider than the foundation wall in order to distribute the structure's weight over a greater surface area of load bearing earth. Therefore, the stability of these structures depends upon the stability of the ground underneath or supporting the foundation. With time, the stability of the underlying soil may change for many reasons, such as changes in the water table, soil compaction, ground movement, or the like. When the stability of the support ground changes, many times the foundation will move or settle. The settling of a structure's foundation can cause structural damage reducing the value of the structure or total property. Inventors have recognized the foundation-settling problem and have developed various devices and methods to correct its effects.

One common device and method to correct foundation settling consists of employing hydraulic jacks in conjunction with piers to lift the foundation. Piers, also known as piles or pilings, are driven into the ground by hydraulic mechanisms until the pier reaches bedrock or until the pier's frictional resistance equals the compression weight of the structure. Once these piers are secured in a stable underground stratum or several stable underground strata, further lifting by the hydraulic jacks raises the level of the foundation. When the foundation is raised to the desired level, the piers are permanently secured to the foundation. The hydraulic jacks are then removed. This method of correcting the level of a foundation generally requires the excavation of a hole adjacent to or underneath the foundation in order to position and operate the lifting equipment.

Foundation lifting devices are well known and exist in many varieties. Methods and devices that lift and support concrete structures are disclosed in three patents issued to the present inventor. In May, U.S. Pat. No. 4,634,319, the present inventor disclosed a method for lifting a structure that requires two separate hydraulic lifting assemblies. A bracket is secured to the building foundation. A hydraulic driving assembly is secured to the bracket to drive a pier into the ground. Once the pier is driven to the desired underground strata, the hydraulic driving assembly is removed. A hydraulic lifting assembly is then placed between the driven pier and the building foundation. The hydraulic lifting assembly then lifts the building foundation to the desired level. Once the foundation is raised to the desired level, a series of adjustable rods are extended down from the bracket to a footer that rests on the pier. When the foundation is secured at that level to the pier, the hydraulic lifting assembly is removed. The device disclosed in this patent is designed to function on the peripheral edge of the foundation.

In the patent issued to May, U.S. Pat. No. 4,800,700, the present inventor disclosed a device and method for lifting concrete slabs. This method comprised the steps of: 1) cutting an access hole in the concrete slab, 2) inserting a lift plate up against the underside of the slab, 3) driving a pier through the access hole through the ground to bedrock or other load bearing strata with a hydraulic driving assembly, 4) removing the hydraulic driving assembly and attaching a hydraulic lifting assembly to the pier and the slab, 5) lifting the slab to the desired height, and 6) securing the pier to the slab and removing the hydraulic lifting assembly. As with the U.S. Pat. No. 4,634,519, this patent requires two hydraulic jacks to complete the process of lifting a concrete foundation or slab. The device and method for lifting a concrete slab is different from the devices and methods used to lift the foundation of a building. This device used to lift a concrete slab is designed to function not on a peripheral edge of the slab, but within an interior portion of the slab.

An additional apparatus for lifting structures is disclosed in May, U.S. Pat. No. 4,854,782. This patent teaches a device and method for lifting a structure that requires two separate hydraulic lifting assemblies. The primary difference between the device taught by this patent and that of the May U.S. Pat. No. 4,634,319 lies in the structure that secures the pier to the foundation. In the U.S. Pat. No. 4,854,782, the pier is supported within a sleeve that is directly secured to the bracket. This structure reduced the number of components that are required to secure a pier to a building from the number used in the U.S. Pat. No. 4,634,319.

Ortiz, U.S. Pat. No. 5,492,437, teaches a lifting device that is made of one or more power cylinders that are pivotally linked to a pier and to a foundation bracket assembly. The pivotal linkage results in self-alignment between the longitudinal axis of the pier and the axis along which compressive pressure is applied to the pier. This patent requires the pier to be lifted above the bracket in order to position the pier within the bracket.

West et al., U.S. Pat. No. 5,246,311, discloses a pier driver having a pair of opposing first upright members straddling a pier support. The upright members are temporarily attached to the foundation and a pair of opposing first foot members operably extending beneath the foundation. A plurality of secondary lifting mechanisms, in cooperation with the piers previously installed by the pier driver, are adapted to lift the foundation. The pier supports of the pier heads are then permanently fixed to the respective piers with a bracket to provide permanent support to the foundation. This patent requires the pier to be lifted above the bracket in order to position the pier within the bracket.

Bellemare, U.S. Pat. No. 5,253,958, describes a device for driving stakes into the ground, particularly a foundation stake used for stabilizing, raising, and shoring foundations. The device disclosed has two rods secured to two hydraulic jacks, the hydraulic jacks and the rods being parallel to the driving axis of the stake. A driving member with a hammering head is provided to drive the stake into the ground. This patent requires that the pier to be lifted above the bracket in order to position the pier within the bracket.

One common feature of the present state of the art is the fact that the pier must be lifted above the bracket that secures the pier to the foundation. This design feature places a significant constraint on the length of piers used. The distance between the top of the bracket and the bottom of the hydraulic cylinder at its maximum position of extension is the maximum permissible length for a pier section that may be used with the device. It may therefore be necessary to use multiple lengths of pipe coupled together in order to form a pier long enough to reach bedrock. Where one pier section is not long enough to reach bedrock, one pier section is inserted within the hydraulic driving assembly and driven into the ground. A drive tool may then be inserted between the pier and the hydraulic cylinder to further drive the pier into the ground. The hydraulic cylinder is then retracted and an additional pier section is placed within the device and coupled to the first pier. The coupled pier is then driven further into the ground. This process is repeated until the pier reaches bedrock.

The shorter the distance between the top of the bracket and the bottom of the hydraulic cylinder at its maximum position of extension, the more pier sections are required to form a pier that reaches bedrock. It is not possible to weld the pier sections together due to the strong possibility that such a process would ignite methane gas trapped within the ground. Therefore, differing non flammable methods of coupling are used. While these couplings are structurally sound, they are not as sound as a pier formed from a single section of pipe that has no couplings. It is therefore desirable to use the longest length of piers possible to reduce the number of pier sections and couplings to limit the chance of mechanical failure.

The present invention is directed toward a device that enables longer sections of piers to be driven into the ground than is disclosed by the present state of the art.

SUMMARY OF THE INVENTION

In accordance with the invention claimed, a device and method to raise the foundation of a structure is disclosed that has a novel bracket assembly that can function with longer lengths of piers. The device is comprised of a bracket that secures to the base of the foundation, a hydraulic pier driving assembly that drives the pier into the ground, and a hydraulic lifting assembly that lifts the building foundation with respect to the pier. The use of the present invention to correct the level of a foundation generally requires the excavation of a hole adjacent to or underneath the foundation in order to position and operate the lifting equipment. The method of raising a building foundation with this device is generally comprised of five steps: 1) excavate a hole around the foundation, 2) secure the bracket to the foundation, 3) attach the hydraulic pier driving assembly to the bracket and drive a pier to bedrock, 4) attach the hydraulic lifting assembly to the bracket and lift the building foundation with respect to the pier, and 5) secured the pier to the bracket.

The bracket, essentially "L" shaped, includes a pier support that directs and stabilizes the pier as it is driven into the ground. In addition, once the pier is driven to its final depth, the pier support serves as the joint that secures the pier to the bracket. The bracket also includes a pair of threaded guide rods that interconnect the bracket to the hydraulic pier driving assembly and the hydraulic lifting assembly.

The key novel feature of the bracket is the removable rear portion. In this embodiment, the removable rear portion is comprised of the three detachable plates. However, other configurations for the removable rear portion are possible. For instance, one large plate may be used to form the removable rear portion. Alternatively, two plates may be used to form the removable rear portion. Through making the rear portion of the bracket removable, the length of the pier is no longer limited to the distance between the top of the bracket and the bottom of the hydraulic cylinder at its maximum position of extension. The pier length is now limited in this device to the distance between the base of the excavated hole and the bottom of the hydraulic cylinder at its maximum position of extension. This design provides for a longer length of pier thereby reducing the numbering of pier lengths and coupling needed to create a pier long enough to reach bedrock.

Once the bracket is secured to the structure, the hydraulic pier driving assembly is attached to the bracket. The three rear plates of the bracket are removed and a pier is inserted within the bracket. The three pier plates are then reattached to the bracket. The hydraulic pier driving assembly drives the pier into the ground. Once the hydraulic cylinder has extended its full length while driving the pier, a drive tool may be inserted between the pier and the hydraulic cylinder to increase the depth that the pier is driven.

If one pier length is not sufficient to reach bedrock, the first pier length is fully driven into the ground. The three rear plates are then detached from the bracket and a second pier section is coupled to the first pier section. The three rear plates are then reattached. The hydraulic pier driving assembly then continues to drive the pier into the ground. This process is repeated until the pier reaches bedrock.

Once the pier reaches bedrock, the hydraulic pier driving assembly is detached from the bracket. The hydraulic lifting assembly is then attached to the bracket. The hydraulic lifting assembly is comprised of a pier plate, a hydraulic plate, and a hydraulic jack. A pair of threaded guide rods are rigidly secured to the bracket with the same connection used by the hydraulic pier driving assembly. The pair of threaded guide rods pass through a pair of holes in the pier plate thereby guiding the movement of the plate. The pier plate is free to move downwardly along the threaded guide rods. The pier plate rests on top of the pier. The hydraulic jack is then positioned on the top surface of the pier plate. The hydraulic plate is then placed on top of the hydraulic jack. The threaded guide rods pass through the holes in the hydraulic plate. The hydraulic plate is secured to the threaded guide rods in a fixed position through the use of threaded nuts operatively engaged to the threaded guide rods. Activating the hydraulic jack, held in a fixed position by the hydraulic plate, causes a downward force against the pier plate thereby creating a force between the building foundation and the pier. Since the pier is driven into bedrock, the force raises the building foundation with respect to the pier.

In order to raise a structure, several hydraulic lifting assemblies must be used in parallel. The hydraulic lifting assemblies are positioned along the building foundation such that the foundation is adequately supported while using a minimum number of lifting assemblies. Once the foundation is lifted to its desired level, the pier is secured to the bracket. The hydraulic lifting assembly is then removed. The excavated ground is then replaced to its original state.

A pier positioned along the peripheral edge of a structure will tend to bend away from the structure under the weight of the structure. Having a rear portion that confines the pier within the bracket restricts the ability of the pier to move away from the bracket secured to the structure. In addition, the pier extends through the bracket up along the side of the structure in its final position. This design feature enhances the structural rigidity of the bracket-pier support thereby reducing the chance of mechanical failure.

The primary object of the present invention to provide a novel device and method for lifting and supporting the foundation of a structure by driving one or more piers into the ground and securing each pier to the foundation once the foundation is raised to the desired level.

Another object of the invention is to develop a method for lifting a building foundation that allows for the use of longer pier sections.

A further object of the invention is to provide a bracket for securing a pier to a foundation that has a removable rear panel thereby allowing pier sections to be positioned sideways within the bracket instead of raising them above the bracket.

A still further object of the invention is to provide a bracket that rigidly secures the pier to the foundation in a manner that is more secure than as previously disclosed in the prior art.

Further objects and advantages of the invention will become apparent as the following description proceeds and the features of novelty which characterize this invention are pointed out with particularity in the claims annexed to and forming a part of this specification.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

DESCRIPTION OF PREFERRED EMBODIMENTS

Figure 1:
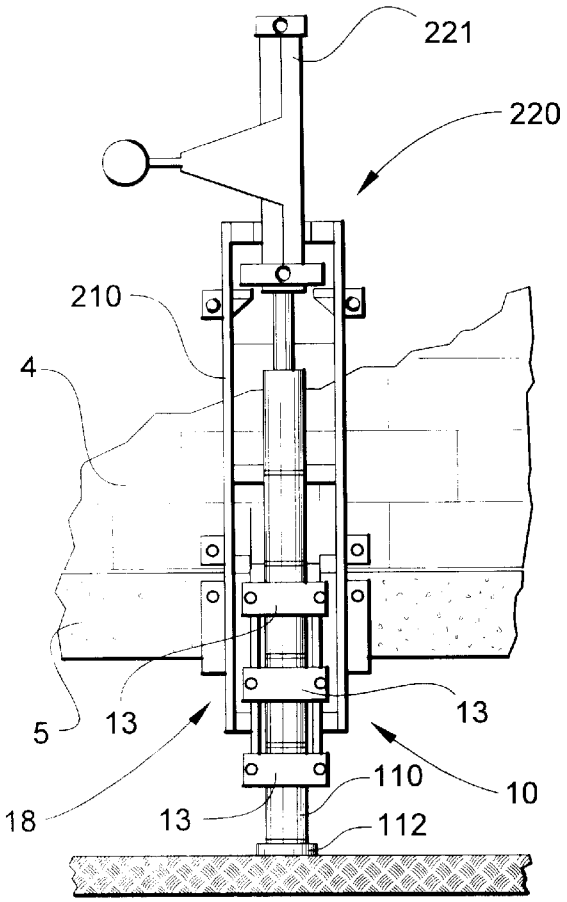
FIG. 1 is a front view of a hydraulic pier driving system secured to a foundation.

Referring to the figures by characters of reference, FIG. 1 discloses a perspective view of a hydraulic pier drive system 1 that is useful for lifting building foundations and the like. The hydraulic pier driving system 1 is secured to a structure 4 having a foundation 5 that is supported by a load bearing stratum 6. The load bearing stratum 6 lies beneath an amount of loose soil or earth 19. Use of the hydraulic lifting system 1 requires excavation of a hole 3 adjacent to or underneath the foundation 5 in order to position and operate the hydraulic lifting system 1.

The process of lifting the foundation 5 of a structure 4 is comprised of two steps. The first step is to drive a pier 110 into bedrock 6 with a hydraulic pier driving assembly 200. The second step is to lift the foundation 5 with respect to the pier assembly 110 using a hydraulic lifting assembly 100. FIGS. 1, 2, 7, 8, and 10 illustrate the devices used to perform step 1. FIGS. 3, 4, 5, 6 and 12 illustrate the devices used to perform step 2.

The hydraulic pier driving system 1 is comprised of a bracket assembly 10 and a pier driving assembly 200. The bracket assembly 10 is made of an "L" shaped bracket 11. Bracket 11 is secured to the foundation 5 through the use of bolts 7 adapted for concrete. It is desirable that the surfaces of bracket 11 fit flush against the surfaces of the foundation 5. The foundation 5 must be prepared to receive bracket 11 by chipping away irregularities from the bottom and side surfaces of the foundation 5. Incorrect preparation of the foundation could allow the bracket 11 to shift with time under the weight of structure 4 resulting in damage to the foundation 5, the pier assembly 110, and the structure 4.

The bracket 11 is welded to two support plates 12. The bracket 11 is provided with a removable rear portion 13. The removable rear portion 13 is comprised of three interconnecting plates 13 that are bolted to the support plates 12 with bolts 17 in this embodiment. Alternative configurations for the removable rear portion 13 are possible. For instance, it is possible to substitute the three plates 13 with one large plate. In addition, the three plates 13 could be replaced with two plates. Essentially, any number of plates having varying configurations are useable for the removable rear portion 13 as long as the plates have sufficient strength to support the pier 110. These three interconnecting plates 13 are the key point of novelty to this invention. When these three plates 13 are removed from the bracket 11, it is possible to insert a pier length sideways into the bracket. The plates 13 allow for the use of longer pier sections 110. If the interconnecting plates 13 were not removable, the pier 110 would have to be risen above the bracket 11 and inserted down through the bracket 11.

The bracket 11, support plates 12, and interconnecting plates 13 form a pier support 18, which supports and guides the pier assembly 110. The bracket 11 is provided with a pair of connectors 14. The connectors 14 are rigidly secured to the side of the bracket 11. The connectors 14 rigidly attach either the hydraulic driving assembly 200 or the hydraulic lifting assembly 100 to the bracket 11.

The hydraulic driving assembly 200 is comprised of a drive stand 210 and a hydraulic cylinder 220. The drive stand 210 is bolted to the bracket 11 at the connectors 14. The drive stand is then bolted to the side of the structure 4. A ram 221 of the hydraulic cylinder 220 presses down against the pier assembly 110. The hydraulic cylinder 220 is a double acting piston and cylinder arrangement that drives the ram 221 against the top portion of the pier 110. The drive stand 210 rigidly secures the hydraulic cylinder 220 to the bracket 11.

FIG. 1. Is illustrative for disclosing the key feature of the present invention and comparing it to the prior art. In the prior art, the rear portion of the bracket assembly, similar to pier assembly 18, is not removable. In the prior art, it is therefore necessary to lower the pier down through the bracket from the top of the bracket. The assemblies of the prior art limited the length of the piers 110 being used to the distance between the top of the bracket 11 and the base of the ram 221. However, in the present invention, the rear portion 13 of the bracket 11 is formed by the three interconnecting plates 13 that are removable. With the three plates 13 removed from the bracket 11, it is possible to insert a pier section 110 into the bracket 11 that has a length extending from the base of the ram 221 to the base of the excavated hole 3. Once the pier section 110 is positioned within the bracket 11, the plates 13 are then reattached to the bracket 11. The three plates 13 form a rear portion 60 of the pier assembly 18.

Figure 2:
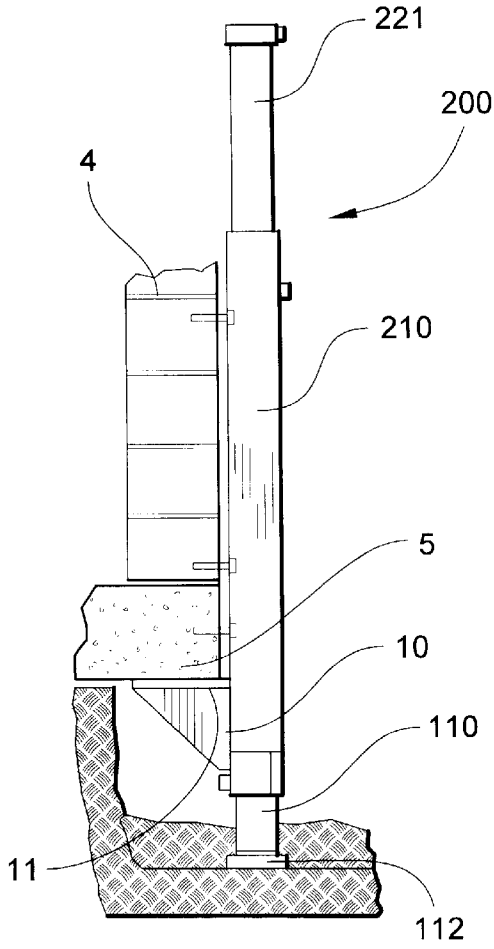
FIG. 2 is a side view of the hydraulic pier driving system secured to the foundation of a structure.

FIG. 2 discloses a side view of the hydraulic pier driving system 1. The hydraulic cylinder 220 will drive the pier assembly 110 into the ground. The base of the pier assembly 110 is provided with an exterior collar 112 to make the size of the hole larger than the size of the pier assembly 110. The creation of the larger hole effectively eliminates the frictional forces along the sides of pier assembly 110 by the ground 19. The hydraulic cylinder 221 will drive the pier assembly 110 until the pier assembly is embedded in bedrock 6. The distance that the pier assembly 110 is driven by the cylinder is limited to the distance the ram 221 may extend. The pier assembly 110 can be driven further than the length of extension of the ram 221 into the ground 19 using a drive tool. The drive tool is typically a solid steel shaft that is inserted between the base of the ram 221 and the top of the pier assembly 110. In the event that one pier section 110 is not sufficiently long enough to reach bedrock 6, a second pier section 110 can be coupled to the first pier section 110.

To insert a second pier section 110 into the bracket 11 and couple it to the first pier section 110, the ram 221 must first be retracted. Then the plates 13 are removed. The second pier section 110 is then inserted into the bracket and coupled to the first pier section 110. The plates 13 are then reattached and the hydraulic cylinder 220 drives the pier into the earth 19 as before. This process is continued until the pier 110 reaches bedrock 6. Once the pier 110 reaches bedrock, step 1 of the process is complete.

Figure 3:
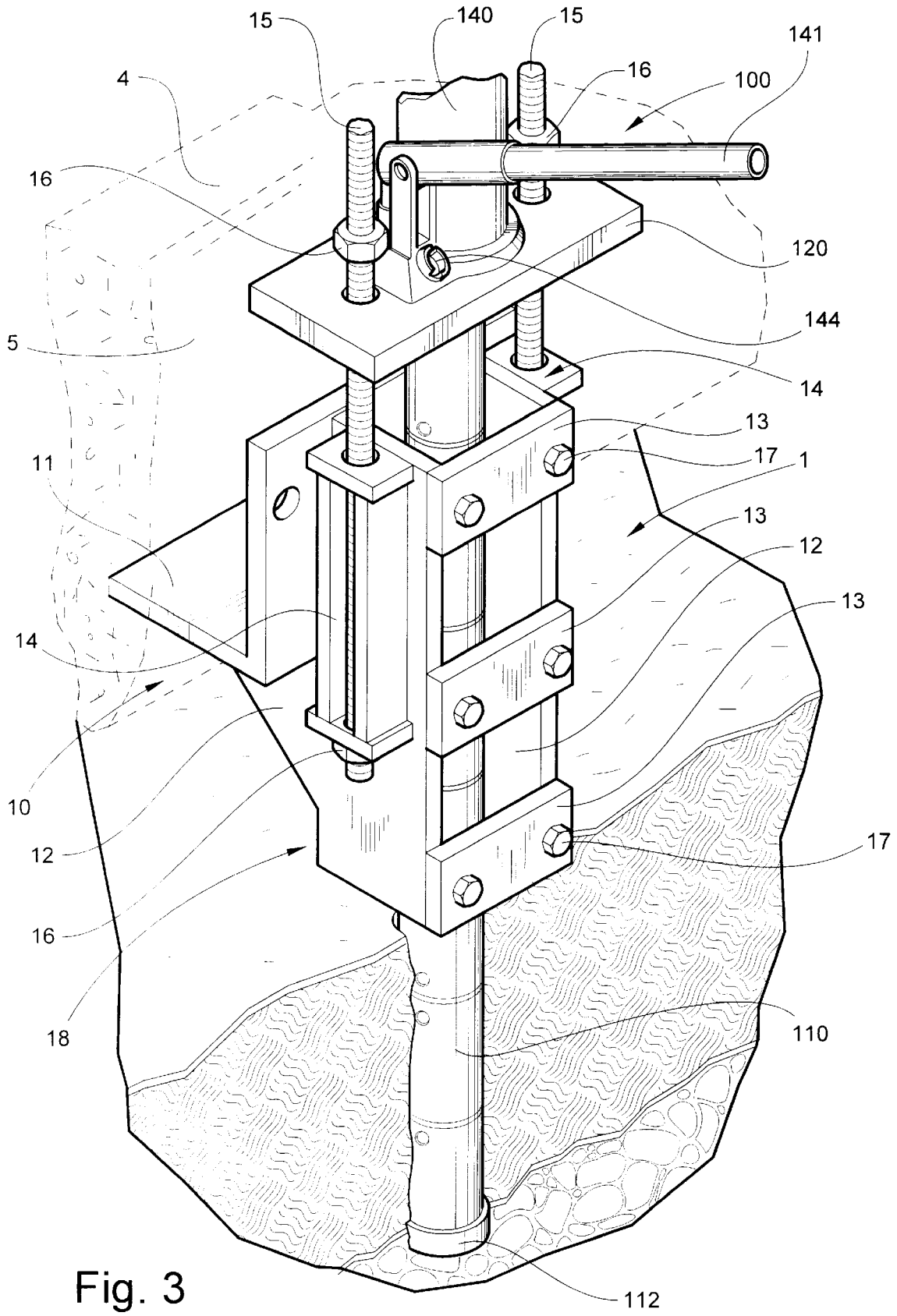
FIG. 3 is a perspective view of a hydraulic lifting system secured to a foundation.
Figure 5:
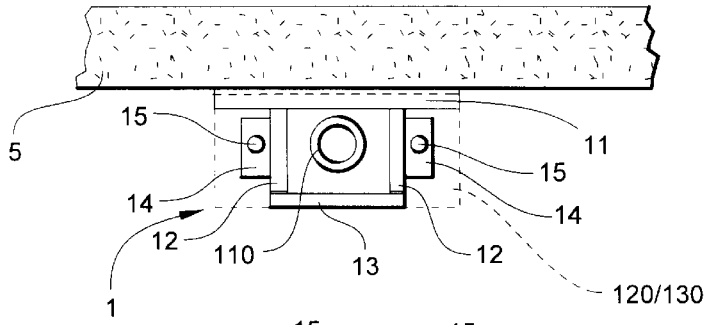
FIG. 5 is a top view of the hydraulic lifting system secured to the foundation of a structure.
Figure 6:
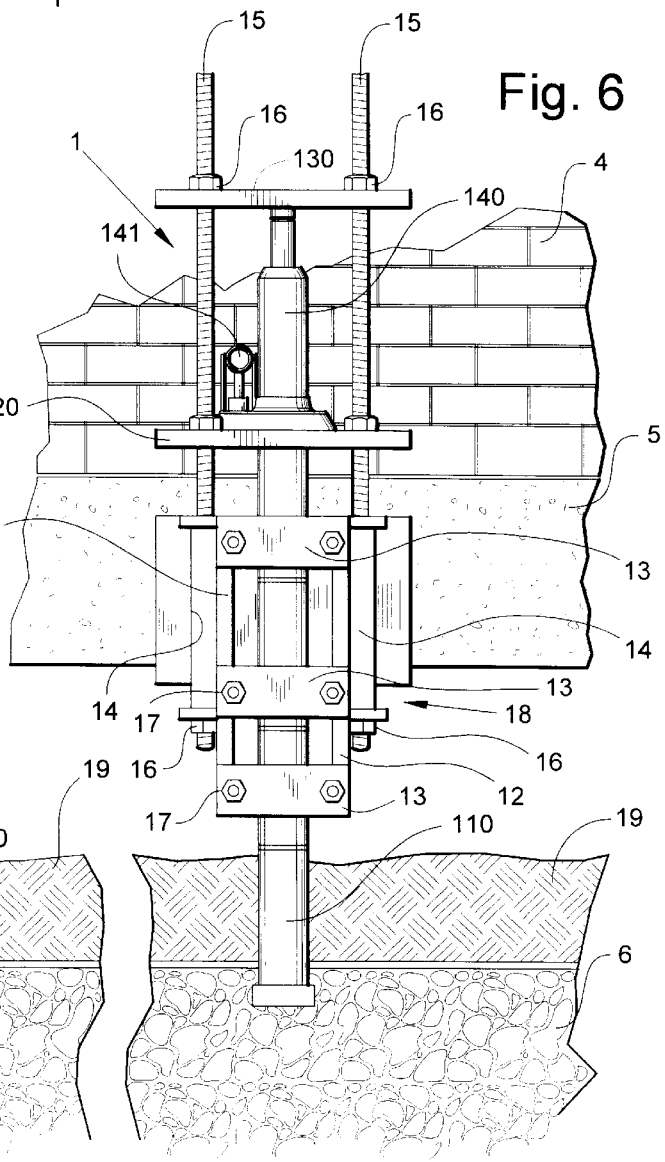
FIG. 6 is a front view of the hydraulic lifting system rigidly secured to the foundation of a structure.

FIGS. 3, 4, 5, 6 illustrate the hydraulic lifting device 100 used to perform step 2, lifting the foundation 5. FIG. 3 provides a perspective view of the lifting device 100. A side view of the hydraulic lifting assembly 100 is provided in FIG. 4. A top view of the hydraulic lifting assembly 100 is disclosed in FIG. 5. FIG. 6 shows a front view of the hydraulic lifting assembly 100. Referring to FIGS. 3–6, the lifting assembly 100 is comprised of a hydraulic jack 140, a pier plate 120, and a hydraulic plate 130. The lifting assembly 100 is attached to the bracket by two threaded guide rods 15. The threaded guide rods 15 are secured to the bracket assembly 10 by the two connectors 14 that are welded to the support plates 12 by threaded nuts 16. The threaded guide rods 15, comprised of a first guide rod 15 and a second guide rod 15, pass through apertures in the connectors 14 and are secured at their base by threaded nuts 16. The pier assembly 110, comprised of one or more pipe sections 111 connected together, is positioned within the pier support 18. The hydraulic jack can be manually operated by a lever 141 or by a hydraulic pump 142 shown in FIG. 10. A hydraulic line 145 connects the hydraulic pump 142 to the hydraulic jack 140. The hydraulic line 145 connects to the hydraulic jack 140 at a connector 144. The interconnecting plates 13 are bolted so that they can be removed from the pier support 18 in order to position the pier 110 in the bracket 11.

Steel is a preferred material for the bracket assembly 10, the lifting assembly 100, and the pier assembly 110. Steel is desirable due to its low cost, durability, and strength. In addition, steel is a preferable material for the pier assembly because the material is easy to weld. Typically, the steel pipe sections comprising the pier assembly 110 are treated and/or coated to resist corrosion, the pier plate 120 is positioned on top of the pier assembly 110 that is held within the pier support 18.

The two threaded guide rods 15 pass through holes 121 in the pier plate 120. A threaded nut 16 and washer are engaged to each threaded guide rod 15 above the pier plate 120. The securing of the pier plate 120 to the threaded guide rods 15 prevents the bracket assembly 10 from moving downward relative to the pier assembly 110. However, the pier plate 120 is designed to move downwardly with respect to the bracket assembly 10 as the pier assembly 110 is driven into the earth 19.

A hydraulic jack 140 is positioned on top of the pier plate 120. A hydraulic plate 130 is then rigidly secured to the bracket assembly 10 on top of the hydraulic jack 140. The two threaded guide rods 15 pass through holes 131 in the hydraulic plate 130. A threaded nut 16 is engaged to each threaded engagement rod 15 above the hydraulic plate 130 thereby rigidly securing it to the bracket assembly 10.

Figure 4:
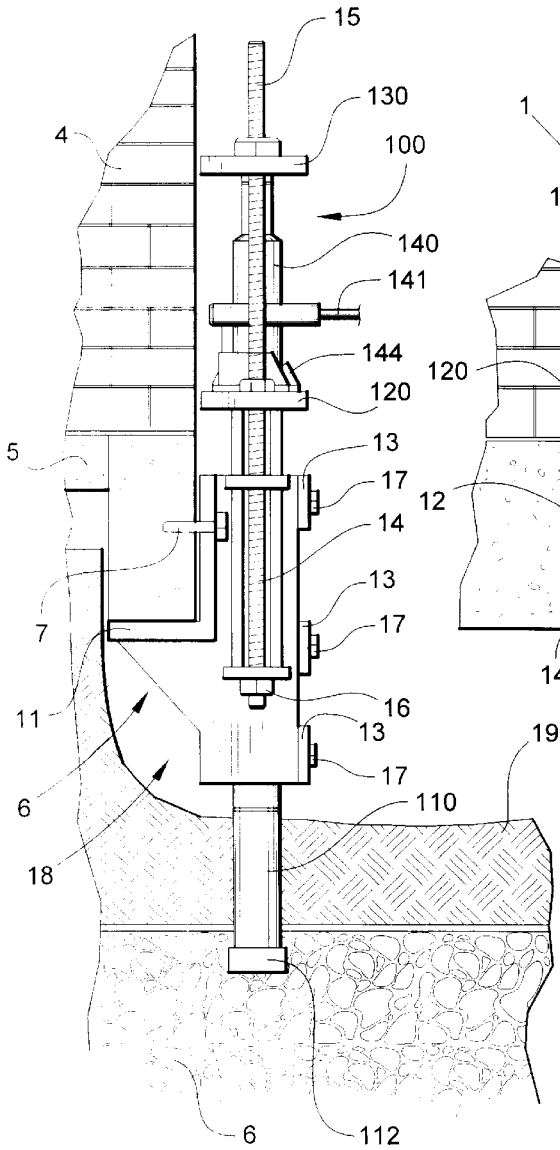
FIG. 4 is a side view of the hydraulic lifting system secured to the foundation of a structure.

The side view of the hydraulic lifting assembly 10 in operative engagement with the foundation 5 of the structure 4 shown in FIG. 4 illustrates how the "L" shaped bracket 11 is fitted flush to the foundation 5. FIG. 5 also shows how the bracket 11 fits flush against the foundation 5. A hole 3 has been excavated from under the foundation in order to position and operate the hydraulic lifting system 1. In FIGS. 3, 4, and 6, the pier assembly 110 is embedded within a layer of bedrock 6. With the pier assembly 110 in engagement with bedrock 6, the hydraulic jack 140 will lift the foundation 5 against the pier 110 higher relative to the load bearing strata 6.

FIG. 6 discloses a front view of the hydraulic lifting assembly 1 secured to the foundation 5 of a structure 4. Once the hydraulic jack 140 has raised the foundation 5 to a desired height, the threaded nuts 16 in operative engagement to the threaded guide rods 15 that are above the pier plate 120 are rigidly tightened to the pier plate 120. These tightened nuts 16 rigidly secure the pier plate 120 against the pier assembly 110 thereby preventing the bracket assembly 10 from downwardly sliding along the pier assembly 110. The pier assembly 110 is held within the pier support 18 formed by plates 12 and 13. The hydraulic plate 130 and the hydraulic jack 140 are then removed from the hydraulic lifting assembly 1. The threaded guide rods 15 are then cut off at a height just above the tightened nuts 16. The hole 3 excavated for this process is then refilled. This last step concludes the second process of lifting the structure 4.

Figure 7:
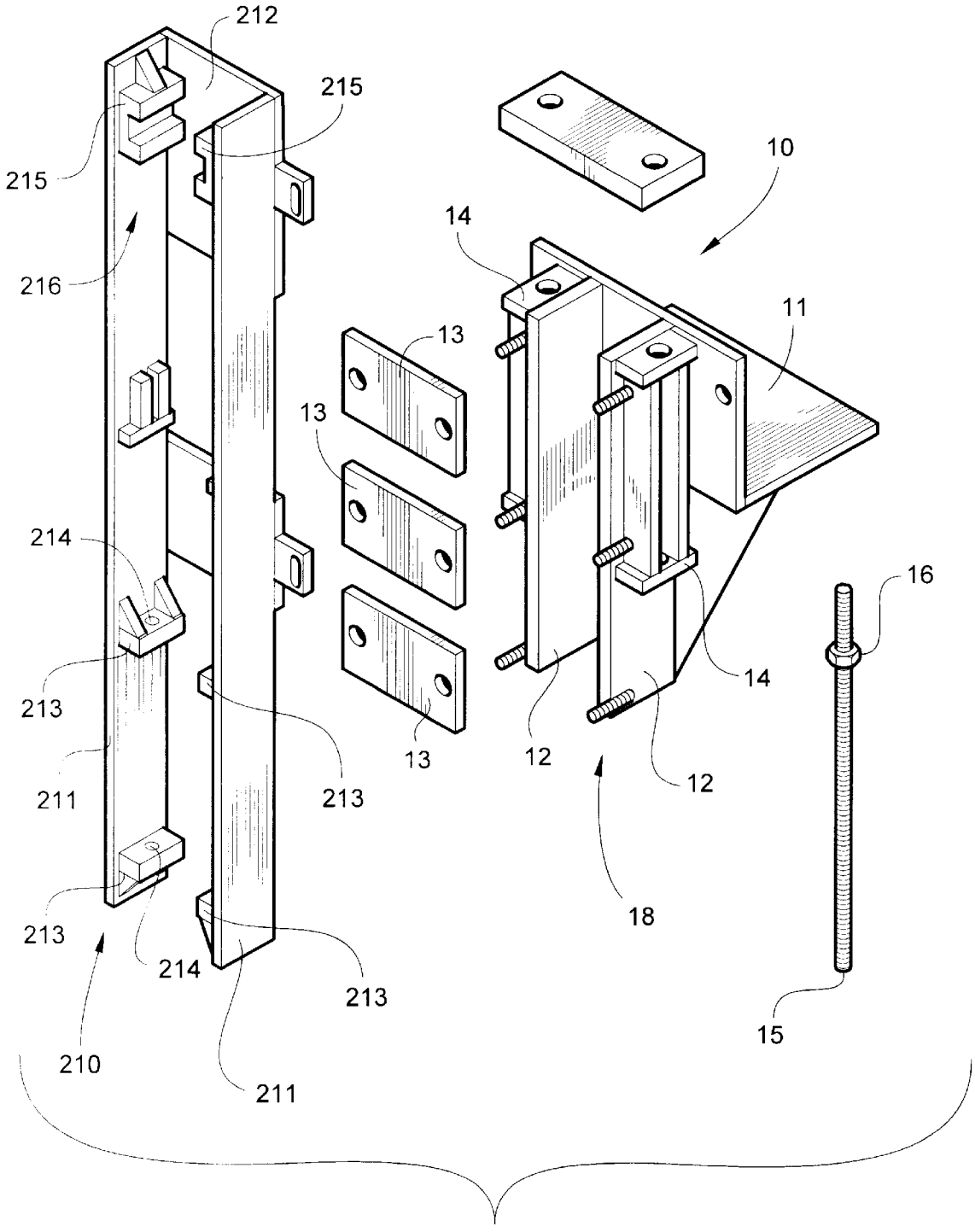
FIG. 7 is an exploded view of the hydraulic pier driving system and bracket assembly.

FIG. 7 illustrates an exploded view of the drive stand 210 connected to the bracket assembly 10. The drive stand 210 is comprised of two side plates 211 that are secured to a front plate 212. Two connector plates 213 are secured on an inside portion of each side plate 211. Each connector plate 213 is provided with a hole 214 through which the rods 15 pass. The connectors 14 fit in between the two connector plates 213. The rod 15 passes through the holes 214 and through the connectors 14. Attaching nuts 16 to the rod 15 secures the drive stand 210 to the pier support 18. The preferred material for the drive stand 210 is steel. Cylinder plates 215 hold the hydraulic cylinder 220 to the drive stand 210. The hydraulic cylinder 220 is positioned at the top portion 216 of the drive stand 210. The cylinder plates 210 are rigidly secured to the side plates 211. The hydraulic cylinder 220 is attached to the cylinder plates 215 by conventional means such as nut and bolt assemblies. In the preferred embodiment, the plates that form the drive stand 210 are welded together. Once the pier assembly 110 is driven to a depth where it engages the layer of bedrock 6, the drive stand 210 holding the hydraulic cylinder 220 is removed from the bracket assembly 10. The hydraulic lifting assembly 100 comprised of the pier plate 120, hydraulic jack 140, and hydraulic plate 130 are then reattached in order to lift the structure 4 with respect to the layer of bedrock 6.

Figure 8:
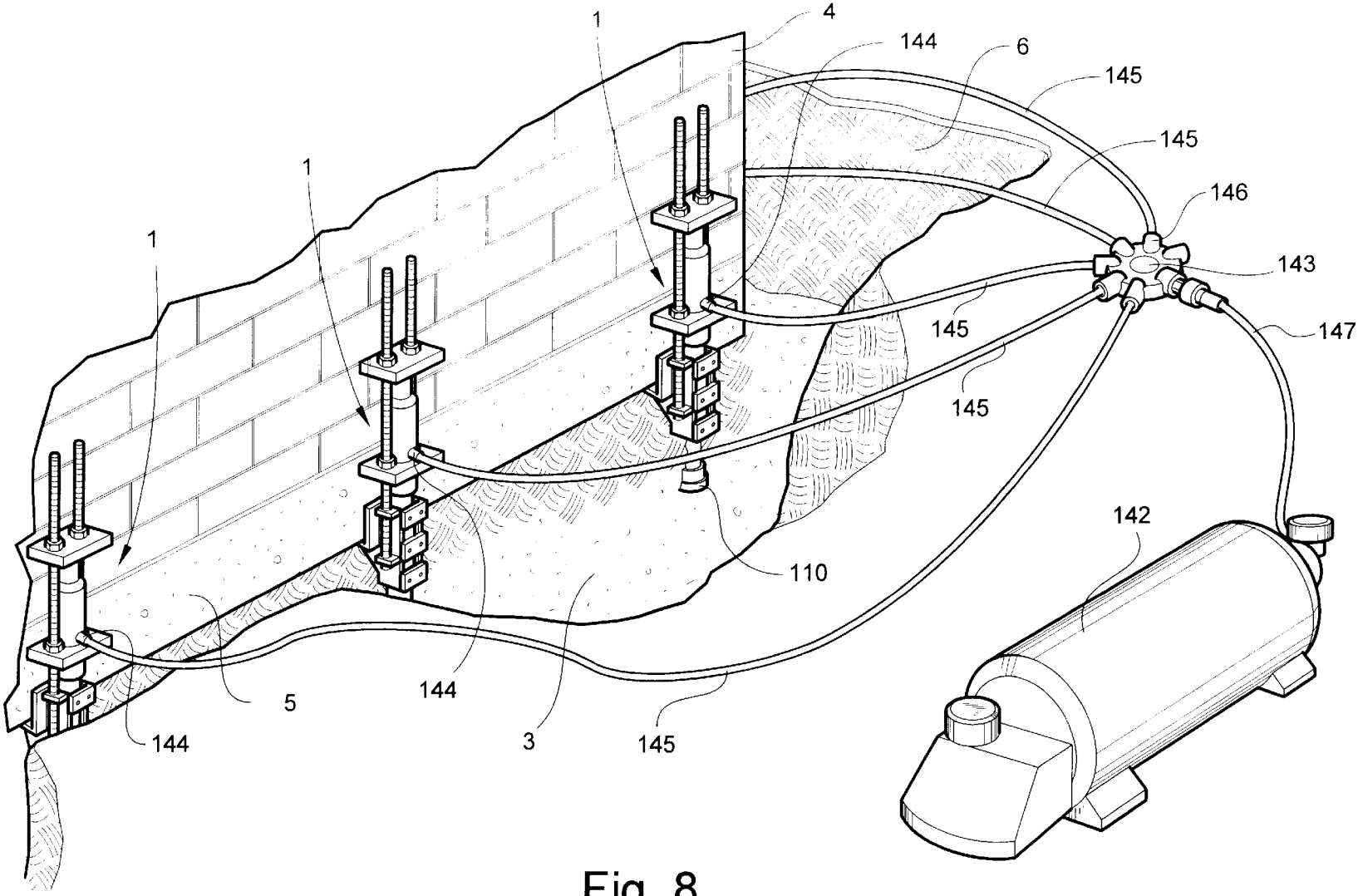
FIG. 8 is a perspective view of a building foundation showing three hydraulic lifting assemblies connected to a hydraulic pump using the hydraulic fluid line splitter.

In order to lift a structure, several hydraulic lifting assemblies 100 must be used simultaneously in parallel. The hydraulic lifting assemblies 100 are positioned along the foundation 5 such that it has sufficient support during the lifting process to ensure that the foundation 5 and the structure 4 are not damaged. In positioning the hydraulic lifting assemblies 1 along the foundation 5, it is desirable to use a minimum number of hydraulic lifting assemblies 1. FIG. 8 discloses a view of a structure 4 being lifted by several hydraulic lifting assemblies 1 simultaneously. As shown, the hydraulic lifting assemblies 1 are positioned along the foundation 5 to ensure that the foundation remains level and does not crack as it is raised. The hydraulic jacks 140 are operated through a hydraulic pump 142. The hydraulic pump is connected to several hydraulic jacks 140 simultaneously through the use of a hydraulic fluid coupler 143. The hydraulic fluid lines 145 that connect the hydraulic pump 142 to the hydraulic jacks 140 attach to the jacks 140 at the coupler 144. A fluid line 145 from each hydraulic jack 140 is secured to the fluid line connectors 146. The main fluid line 147 connects the hydraulic pump 142 to the coupler 143.

The present invention is structurally different from the hydraulic lifting systems disclosed by the present inventor in the U.S. Patents issued to him numbered U.S. Pat. Nos. 4,634,319, 4,800,700, and 4,854,782. First, the U.S. Pat. No. 4,800,700 applies to lifting concrete slabs at positions within the interior of the slab. This patent does not address how to raise a building foundation along the peripheral edge of the foundation. Second, the bracket and assembly used to secure the pier 110 to the foundation 5 in the present invention is novel over the bracket assemblies disclosed in the U.S. Pat. Nos. 4,634,319 and 4,854,782. Neither of these two patents disclose a bracket assembly 10 that has a removable rear portion 13 that can be detached to permit a pier 110 to be positioned sideways within the bracket assembly 10. The U.S. Pat. No. 4,634,319 teaches a bracket assembly that has adjustable rods that extend downwardly from the bracket to engage the top surface of a plate that rests on top of the pier. The bracket 11 of the present invention is not provided with adjustable rods that extend downwardly toward the plate resting on the pier. The bracket of the U.S. Pat. No. 4,634,319 does not have any sort of rear portion that supports the pier. The bracket 11 of the present invention directly secures the pier to the building within the pier support 18. In contrast, the bracket of the U.S. Pat. No. 4,634,319 merely rests upon the top of the pier. There is no structure disclosed in the U.S. Pat. No. 4,634,319 that couples or attaches the pier to the bracket. The U.S. Pat. No. 4,854,782 teaches a bracket assembly that has a cylindrical sleeve in which the pier is held. The bracket of the U.S. Pat. No. 4,854,782 does not include a removable rear portion. Further, the pier of the U.S. Pat. No. 4,854,782 is positioned such that it only extends half way up the height of the bracket. In contrast, the pier 110 of the present invention extends the full height of the bracket 10. Through having the pier 110 extend the full length of the bracket 10, this pier-bracket assembly is structurally more stable than the pier-bracket assembly of the U.S. Pat. No. 4,854,782.

While these descriptions directly describe the above embodiments, it is understood that those skilled in the art may conceive modifications and/or variations to the specific embodiments shown and described herein. Any such modifications or variations that fall within the purview of this description are intended to be included therein as well. It is understood that the description herein is intended to be illustrative only and is not intended to be limitative. Rather, the scope of the invention described herein is limited only by the claims appended hereto.

What is claimed is:

1. An apparatus which raises and supports a foundation of a structure, said apparatus comprising:

A. an "L" shaped bracket that engages said foundation;

B. a pier assembly;

C. a pier support having a removable rear portion, said pier assembly extends through said pier support, said pier support is secured to said "L" shaped bracket whereby the longitudinal axis of said pier assembly is adapted to be positioned substantially vertical relative to said ground;

D. a guide rod, said guide rod is secured to said pier support, the longitudinal axis of said guide rod is parallel to the longitudinal axis of said pier;

E. a pier plate, said pier plate is attached to said guide rod, said pier plate resting on top of said pier assembly thereby holding said pier assembly in a fixed position relative to said pier support;

F. a hydraulic jack, said hydraulic jack rests on top of said pier plate; and

G. a hydraulic plate, said hydraulic plate rests on top of said hydraulic jack, said hydraulic plate is rigidly secured to said guide rod thereby holding said hydraulic jack in a fixed position relative to said "L" shaped bracket.

2. The apparatus as recited in claim 1, further comprising a second guide rod, said second guide rod secured to said bracket whereby the longitudinal axis of said second guide rod is parallel to the longitudinal axis of said pier assembly, said pier plate attached to said second guide rod, said hydraulic plate is rigidly secured to said second guide rod.

3. The apparatus as recited in claim 2, wherein said removable rear portion is comprised of a plate.

4. The apparatus as recited in claim 3, wherein said plate is removably attached to said pier support with a bolt.

5. The apparatus as recited in claim 4, wherein said guide rod and said second guide rod are both threaded.

6. The apparatus as recited in claim 5, wherein said hydraulic plate is rigidly secured to said guide rod and said second guide rod by a plurality of threaded nuts, said threaded nuts being operatively engaged to said guide rod and said second guide rod.

7. The apparatus as recited in claim 6, wherein the upward vertical motion of said pier plate is restricted by the plurality of threaded nuts, said threaded nuts being operatively engaged to said guide rod and said second guide rod.

8. The apparatus as recited in claim 7, wherein said pier plate is parallel to said hydraulic plate.

9. The apparatus as recited in claim 8, wherein said removable rear portion is comprised of an additional two plates.

10. An apparatus for driving a pier into the ground, comprising:

A. an "L" shaped bracket that is adapted to engage a foundation of a structure;

B. a pier support having a removable rear portion, said pier support being secured to said "L" shaped bracket;

C. a drive stand, said drive stand being removably secured to said pier support, said drive stand being adapted to secure to the foundation of said structure;

D. a hydraulic cylinder secured to a top portion of said drive stand, said hydraulic cylinder is provided with a ram, a pier extends longitudinally through said pier support and said drive stand, said ram engages said pier.

11. The apparatus as recited in claim 10, wherein said removable rear portion is comprised of a plate.

12. The apparatus as recited in claim 11, wherein said plate is removably attached to said pier support with a bolt.

13. A method for lifting the foundation of a structure comprising the steps of:

A. attaching an "L" shaped bracket to said foundation, said "L" shaped bracket having a pier support rigidly secured thereto;

B. placing a pier comprised of a pipe within said pier support whereby said pier is positioned vertically relative to said "L" shaped bracket;

C. attaching a removable rear portion to said pier support;

D. driving said pier toward a bedrock stratum with a hydraulic jack;

E. lifting said foundation relative to said pier embedded in said bedrock stratum;

F. rigidly securing said foundation to said pier.

14. An apparatus for raising and supporting a foundation of a structure, said apparatus comprising:

A. an "L" shaped bracket that is adapted to engage a foundation;

B. a pier assembly;

C. a pier support having a removable rear portion, said pier assembly extends through said pier support, said pier support is secured to said "L" shaped bracket whereby the longitudinal axis of said pier assembly is adapted to be positioned substantially vertical relative to said ground;

D. a guide rod, said guide rod is secured to said pier support, the longitudinal axis of said guide rod is parallel to the longitudinal axis of said pier;

E. a pier plate, said pier plate is attached to said guide rod, said pier plate resting on top of said pier assembly thereby holding said pier assembly in a fixed position relative to said pier support;

F. a hydraulic jack, said hydraulic jack rests on top of said pier plate; and

G. a hydraulic plate, said hydraulic plate rests on top of said hydraulic jack, said hydraulic plate is rigidly secured to said guide rod thereby holding said hydraulic jack in a fixed position relative to said "L" shaped bracket.

* * * * *